US006309471B1

(12) United States Patent
Smith et al.

(10) Patent No.: US 6,309,471 B1
(45) Date of Patent: Oct. 30, 2001

(54) RAPID REMOVAL OF IODINE STAINS

(75) Inventors: Kim R. Smith, Woodbury, MN (US); Robert D. P. Hei, Baldwin, WI (US); Mark Levitt, St. Paul, MN (US)

(73) Assignee: Ecolab, Inc., St. Paul, MN (US)

( * ) Notice: Subject to any disclaimer, the term of this patent is extended or adjusted under 35 U.S.C. 154(b) by 0 days.

(21) Appl. No.: 09/549,653

(22) Filed: Apr. 14, 2000

(51) Int. Cl.[7] ..... C23G 1/02

(52) U.S. Cl. ..... 134/28; 134/2; 134/3; 134/36; 134/41; 134/42; 510/109; 510/214; 510/238; 510/278; 510/281; 510/405

(58) Field of Search ..... 134/2, 3, 28, 36, 134/41, 42; 510/214, 238, 281, 109, 278, 405

(56) References Cited

U.S. PATENT DOCUMENTS

| | | | | |
|---|---|---|---|---|
| 3,953,352 | * | 4/1976 | Mizutani et al. | 252/142 |
| 4,828,569 | | 5/1989 | Heath et al. | 8/137 |
| 5,348,679 | * | 9/1994 | Weinhold et al. | 252/105 |
| 5,669,937 | | 9/1997 | McBride et al. | 8/137 |

* cited by examiner

*Primary Examiner*—Sharidan Carrillo
(74) *Attorney, Agent, or Firm*—Vidas, Arrett & Steinkraus

(57) ABSTRACT

The present invention relates to an improved method of removing iodine stains comprising contacting a surface having an iodine stain with a liquid cleaning composition for a sufficient time to decolorize the stain said cleaning composition comprising about 1% to about 100% by weight of at least one compound selected from the group consisting of salicylic acid, salicylic acid derivatives and mixtures thereof, and at least one solvent. The liquid cleaning composition has an adjusted pH of about 1–14.

24 Claims, No Drawings

RAPID REMOVAL OF IODINE STAINS

FIELD OF THE INVENTION

The present invention relates to an improved method of removing iodine stains wherein a surface having an iodine stain is contacted with a liquid cleaning composition comprising salicylic acid, a salicylic acid derivative or a mixture thereof, and at least one solvent. Antimicrobial agents may optionally be added to the composition. Further, the composition can be modified for use in the removal of rust stains.

BACKGROUND OF THE INVENTION

Iodine and iodophors are widely used in antiseptics and disinfectants to prevent the growth of microorganisms, and for treating and preventing local infections and in controlling the spread of disease, and are thus widely used in medical or health care facilities, institutional facilities, industrial facilities and so forth.

Iodophors are complexes of iodine with solubilizers or carriers which are typically polymers such as polyvinyl pyrrolidone or polyethylene glycol, or certain types of surface active agents that have detergent properties. The iodophors complex iodine and facilitate the liberation of free iodine in solution. Commonly used iodophors include iodine complexed with nonionic surfactants, iodine complexed with glycol ether, and iodine complexed with polyvinylpyrrolidone (1-ethenyl-2-pyrrolidone homopolymer compound). The latter is probably the most widely used iodophor and is generally known as Povidone-Iodine, U.S.P.; see The Merck Index, 10th Edition, monograph 7595 (1983).

Povidone-iodine products are commercially available in a variety of forms including antiseptic gels, ointments, solutions, scrubs, and so forth. Povidone-iodine is commonly found under the name of Alphadine®, a trademark of Ecolab Inc. located in St. Paul, Minn. Some formulations are bacteriostatic or microbiocidal, killing gram negative and gram positive bacteria, fungi, viruses, protozoa and yeasts.

Hospitals, nursing homes and other health care facilities routinely use povidone-iodine formulations in surgical and other procedures, and for patient care. It is inevitable that hospital linens including sheets, gowns, drapes, and other textile products will become soiled with povidone-iodine complex stains. Spills commonly occur resulting in the soiling of floors, countertops, and walls as well. In the case of flooring such as tile, the povidone-iodine complex will go right through the floor finish to the tile below, resulting in the necessary replacement of the tile. Furthermore, these stains, containing not only iodine, but a polymeric complexing agent, are very difficult to remove by the usual cleaning and laundering techniques, and with the currently available detergent products.

U.S. Pat. No. 4,828,569 describes a detergent composition for removing povidone-iodine-complex antiseptics from stained linens. The detergent composition contains N-alkyl-2-pyrrolidone, gamma butyrolactone, 2-ethyl-1,3-hexanediol or 4-methyl-1,3-dioxolane-2-one.

U.S. Pat. No. 5,669,937 describes a method of decolorizing iodine stain on a substrate, and in particular, to a method employing a carboxyalkene which may undergo iodolactonization.

An alternative solution is to use sodium thiosulfate which is a good reducing agent. Typically, a paste of sodium thiosulfate is made, applied to the stain, and allowed to stand for 24 hours. This is a tedious process, however, and more desirable solutions are needed.

The present inventors have found an improved composition for removing iodine stains. The composition contains at least one of salicylic acid, salicylic acid derivative or mixture thereof, and at least one solvent.

SUMMARY OF THE INVENTION

The present invention relates to various methods of employing a composition based on a compound selected from the group consisting of salicylic acid, salicylic acid derivatives and mixtures thereof, and at least one solvent. Optionally, the composition may contain a surfactant, or a blend of surfactants.

In particular, the present invention relates to an improved method of removing iodine stains comprising applying a cleaning composition to a surface having a povidone-iodine stain and allowing the cleaning composition to set for an amount of time sufficient to decolorize the stain. The cleaning composition comprises at least one organic acid, organic acid salt thereof, or mixtures thereof and at least one solvent.

In particular, the present invention relates to an improved method of removing iodine stains comprising contacting a surface having an iodine stain with a liquid cleaning composition for a sufficient time to decolorize the stain. The liquid cleaning composition comprises about 1% to about 100% by weight of at least one compound selected from the group consisting of salicylic acid, salicylic acid derivatives and mixtures thereof, and at least one solvent.

If the composition is supplied as a dilutable concentrate, the salicylic acid/salicylic acid derivatives are present from about 10% to about 100% by weight of the composition, and a recommended range of dilution with water is anywhere from about 10:1 to about 1:10.

If the composition is supplied in a ready-to-use solution, the salicylic acid and/or salicylic acid derivatives will be present at a concentration of about 1% to about 20% by weight of the composition.

In another aspect, the present invention relates to a method of removing rust comprising contacting a metal surface having rust with a liquid cleaning composition for a sufficient time to remove the rust. The liquid composition comprises about 1% to about 20% by weight of at least one compound selected from the group consisting of salicylic acid, salicylic acid derivatives and mixtures thereof, and at least one solvent.

The liquid compositions of the present invention have an adjusted pH of about 1–14.

In another aspect, the present invention relates to an antimicrobial delivery system comprising about 1% to about 99.9% by weight of at least one compound selected from the group consisting of salicylic acid, salicylic acid derivatives and mixtures thereof, at least one antimicrobial agent, and at least one solvent.

DETAILED DESCRIPTIONS OF THE PREFERRED EMBODIMENTS

The compositions and methods of the present invention employ a compound that is based on an organic acid or organic acid salt, and in particular on salicylic acid (o-hydroxybenzoic acid), salicylic acid derivatives or a mixtures thereof.

Salicylic acid derivatives useful herein include salicylates such as salicylate esters, ammonium salicylates, or the salts of salicylic acid such as alkali metal or alkaline earth metal salicylic acid salts, and so forth. More specifically, useful salicylate derivatives include dipotassium 5-sulfosalicylate, ammonium salicylate, choline salicylate (β-hydroxyethyltrimethylammonium salicylate), lithium salicylate, magnesium salicylate, potassium salicylate, sodium salicylate, triethanolamine salicylate, and so forth. Desirably, the salicylic acid salts exhibit good water solubility. For example, sodium salicylate and potassium salicylate exhibit good water solubility and are preferable for use herein.

The salicylic acids or derivatives thereof are useful from about 0.1% to about 99.9% by weight of the composition, preferably from about 1% to about 60% by weight of the composition, and most preferably from about 10% to about 45% by weight of the composition.

The iodine stain removal composition may be supplied as a concentrate where dilution is recommended, or in a ready-to-use solution.

Ready-to-use solutions preferably comprise from about 0.01% to about 50% by weight salicylic acid by weight of the composition, and preferably from about 1% to about 20% by weight of the composition. Concentrates preferably comprise from about 10% to about 100% by weight of the composition. If the composition is supplied as a concentrate, it may be diluted with water at a ratio of about 10:1 to about 1:10, and preferably, from about 4:1 to about 1:4 depending on the original concentration, and its intended use.

The solvents useful herein are those in which salicylic acid or its derivative are soluble and/or emulsifiable. Examples of suitable solvents include $C_{1-6}$ alkanols, glycol ethers including $C_{3-24}$ alkylene glycol ether, water and so forth, and mixtures hereof. Alkanols include methanol, ethanol, n-propanol, isopropanol, butanol, pentanol, hexanol, and their various positional isomers. Diols useful herein include methylene, ethylene, propylene, butylene and hexylene glycols, and mixtures thereof.

Alkylene glycol ether solvents include ethylene glycol monobutyl ether, ethylene glycol monopropyl ether, propylene glycol n-propyl ether, propylene glycol monobutyl ether, dipropylene glycol methyl ether, propylene glycol t-butyl ether, and so forth.

In particular, salicylic acid is soluble in acetone, ethanol, ether, glycol ether, and water. The alkali metal salicylic acid salts, for example lithium, potassium or sodium salicylate, are typically soluble in alcohol (typically ethanol), water, glycol ether and glycerin. Alkaline earth metal salicylates such as magnesium salicylate, calcium or barium saticylate are soluble in alcohol, water and glycol ether. Solubilities of the alkali metal salicylates and the alkaline earth metal salicylates will vary somewhat depending on the metal chosen for use. Ammonium salicylate is soluble in alcohol, glycol ether and water. Preferable solvents include water and glycol ethers.

The solvents are useful from about 0.1% to about 99.9% by weight of the composition, preferably from about 10 to about 98%, more preferably from about 25% to about 90% by weight of the composition and most preferably from about 35% to about 80% by weight of the composition.

Optionally, antimicrobial agents can be added to the compositions of the present invention. The antimicrobial agents useful herein include substituted phenolics such as parachlorometaxylenol (PCMX), halogens, peroxygen compounds, i.e. peroxides or peracids, quaternary ammonium compounds such as benzalkonium chloride and dialkyldimethyl ammonium chloride, metal derivatives, amines, alkanolamines and nitro derivatives, anilides, organosulfur and sulfur nitrogen compounds, and so forth. Preferable antimicrobial agents for use herein include the substituted phenolic compounds, quaternary ammonium compounds, or peroxygen species.

The antimicrobial agents are useful from about 0.1% to about 20% by weight of the composition, preferably from about 0.2% to about 15% by weight of the composition, even more preferably from about 0.5% to about 10%, and most preferably about 1to about 10% by weight of the composition.

The cleaning composition of the present invention preferably has a pH in the range of about 1–14. More preferably, the pH is adjusted to a range of about 7–14, even more preferably the pH is adjusted to a range of about 10–14, even more preferably the pH is adjusted to a range of about 11–14, and most preferably the composition has an adjusted pH of about 12–14. Compounds useful for adjusting the pH include alkali metal hydroxides, alkali metal carbonates, ammonium hydroxide, alkanolamine, mono-, di- and trimethyl amines, and so forth. Surprisingly, the higher the pH is within the preferred range, the quicker the composition effectively removes iodine stains. Even more surprisingly, the composition effectively removes iodine at a high pH independent of the concentration of salicylic acid or its derivatives.

Optionally, a surfactant may be added to the compositions of the present invention to improve surface wetting. The surfactants useful herein include anionic, nonionic, amphoteric and mixtures thereof.

The anionic surfactants useful herein include but are not limited to alkyl and alkyl ether sulfates such as ammonium lauryl ether sulfate, sulfated monoglycerides, sulfonate olefins such as sodium alpha olefin sulfonate, alkyl aryl sulfonates such as sodium dodecyl benzene sulfonate, primary or secondary alkane sulfonates, alkyl sulfosuccinates, acyl taurates, methyl acyl taurates, acyl isethionates, alkyl glycerylether sulfonate, sulfonated methyl esters, sulfonated fatty acids, alkyl phosphates, acyl glutamates, acyl sarcosinates, alkyl sulfoacetates, acylated peptides, alkyl ether carboxylates, acyl lactylates, anionic fluorosurfactants, ethoxylated alkyl sulfates, alkyl glyceryl ether sulfonates, fatty acyl glycinates, alpha-sulfonated fatty acids, their salts and/or their esters, alkyl ethoxy carboxylates and mixtures thereof.

Any counter cation, M, can be used on the anionic surfactant. Preferably the counter cation is selected from the group consisting of sodium, potassium, ammonium, monoethanolamine, diethanolamine, and triethanolamine. More preferably the counter cation is ammonium.

The nonionic surfactants useful herein include but are not limited to ethoxylated alcohols including myristeth-7 and nonyl phenol ethoxylate, and fatty alcohol ethoxylates and/or propoxylates, alkyl polyglycosides, POE(20) sorbitan monooleate, polyethylene glycol cocoate, propylene oxide/ethylene oxide block polymer, alkanolamines, alkyldimethyl oxides, coconut monoethanolamine, cetyldimethylamine oxide, stearamine oxide, oleamine oxide, cocamidopropylamine dimethy oxide, and so forth.

The amphoteric or zwitterionic surfactants useful herein include but are not limited to betaines and sulfobetaines including alkyl betaines (oleyl betaine and lauryl betaine), cocamidopropyldimethyl betaine, cocamido betaine, alkyl sultaines, alkyl amphoacetates (cocamphoacetate), alkyl amphodiacetates (cocamphodiacetate), alkyl amphopropionates, alkyl amphodipropionates (cocamphocarboxypropionate), cocamphocarboxy propionic acid, cocamidopropylhydroxysultaine, amine oxides, and so forth.

The surfactant system may also be composed of a combination of surfactans. For example, the surfactant system may be composed of a mixture of one or more surfactants of either the same type, or of different types. For example, anionic surfactants may be used in combination with nonionic or amphoteric surfactants. Various conventional surfactant systems are commercially available and are known to those of skill in the art. This list is not an exclusive list and is only intended as a guide. Surfactants are discussed in detail in *McCutcheon's Detergents and Emulsifiers,* 1999, North American Edition, MC Publishing Co. One of ordinary skill in the art would know how to select surfactants for use in such systems. The surfactants are useful from about 0.1% to about 30% by weight of the composition, and preferably from about 0.1% to about 20% by weight of the composition, whether in a concentrate, or in a diluted form.

The compositions of the present invention are useful for a variety of purposes including cleaning and stain removal, and rust removal. The compositions have exhibited an ability to clean iodine stains very quickly. Literature has reported methods which involve treatment times of up to 24 hours such as the thiosulfate pastes. In contrast, the present compositions can decolorize povidone-iodine stains in less than 5 hours, preferably less than 1 hour, more preferably less than 15 minutes, even more preferably less than 5 minutes, and most preferably less than 1 minute after application of the cleaning composition to the stain.

The compositions of the present invention may be utilized on porous or fibrous materials or surfaces, non-porous materials or surfaces, and hard surfaces, for instance. Hard surfaces may be porous or fibrous, or non-porous.

For hard surfaces such as floors, walls, countertops, and so forth, the composition is applied to the surface, and allowed to stand on the stain until the stain is decolorized. Optionally, mechanical agitation may be utilized to remove the stain. Once the stain is decolorized, the liquid may be wiped off. Optionally, the treated surface may be rinsed. The composition may be used on any type of flooring including carpeted flooring, tile, finished floors (i.e. coatings), and so forth.

In a preferred embodiment of the present invention, a 20% solution of potassium salicylate was utilized, a povidone-iodine stain was decolorized from a finished tile floor in about 1 minute or less.

Porous or fibrous surfaces or materials include lube belts, woven and non-woven textiles, coverings for floors and walls including carpets and some types of wallpaper, and so forth.

The compositions of the present invention are also useful on textiles including cottons, polyesters, polyamides and blends of such materials.

The compositions of the present invention are also useful for removing rust. The concentration of the salicylic acid, salicylic acid derivative, or mixture thereof is preferably about 1% to about 20% by weight of the composition. The composition is applied to the area of metal where it is desirable to remove the rust and allowed to set for a time sufficient to remove the rust. Optionally, rinsing and/or abrading steps may be added to he removal method. The area may then be wiped or rinsed free of the rust.

One of skill in the art would understand that various modifications may be made to the compositions and methods of the present invention without departing from the spirit and scope of the invention.

The following nonlimiting examples further illustrate the present invention. These examples are in no way intended to limit the scope of the invention.

EXAMPLES

Example 1 and Comparative Examples A–G

Example 1, prepared according to the present invention, was compared to several comparative examples.

First, a (48 g/gallon; 5% active) choline diiodochloride/citric acid mixture was applied to a tile coated with a Laser® finish available from Ecolab Inc. in St. Paul, Minn. This solution was allowed to set for 1 hour and was then rinsed to yield a yellow stain on he finish. The stain was then treated with various solutions. The solutions were allowed to set on the stain for approximately 30 minutes. The results may be found in Table 1.

TABLE 1

| | Solution Type | Stain Discolored? |
|---|---|---|
| Example 1 | 23% dipotassium salicylate | yes |
| Comp A | 30% sodium thiosulfate | no |
| B | 45% potassium hydroxide | no |
| C | linoleic acid | no |
| D | water | no |
| E | 35% hydrogen peroxide | no |
| F | 10% chlorine bleach | no |
| G | copper iodide (suspension) | no |

Example 2

The pH of a solution (23%) of salicylic acid was varied through the addition of potassium hydroxide. The resulting compositions were used to treat a povidone-iodine stain on a finished floor. The amount of time required to discolor the stain at the various pH levels was recorded. The results are found in the following table.

TABLE 2

| pH | Time required to destain |
|---|---|
| 3 | very slow |
| 7 | >1 hour |
| 10 | 15 minutes |
| 12 | ~1 minute |

Example 3

A cotton swatch was treated with an ~20% povidone-iodine slurry which formed a lark stain. This was then allowed to air dry. The stain was not removed after washing with water. One drop of a 23% dipotassium salicylate (pH=12) was applied to the stain and the cotton turned white within 2–3 minutes.

Example 4

An uncoated flooring tile was treated with an ~20% povidone-iodine slurry, air dried, rinsed, and air dried a second time. The concentration of a salicylic acid solution was varied by diluting a 23% dipotassium salicylate (pH=12). The concentration versus the rate of stain decolorization was recorded with the following results.

TABLE 3

| Concentration | Time required to decolorize the stain |
|---|---|
| 5% | <1 minute |
| 10% | <1 minute |
| 23% | <1 minute |

Example 5

A 23% solution of dipotassium salicylate (pH=12) was used to rinse a pair of rusted forceps. After treatment, the forceps were rinsed with tap water resulting in removal >50% of the rust.

What is claimed is:

1. A method of removing iodine stains comprising the steps of contacting a surface having an iodine stain with a liquid cleaning composition to decolorize said iodine stain, said liquid composition comprising about 1% to about 100% by weight of at least one compound selected from the group consisting of salicylic acid, salicylic acid derivatives and mixtures thereof and at least one solvent with which said at least one compound is soluble or emulsifiable, said liquid composition having an adjusted pH of about 1–14 and removing said decolorized iodine stain from said surface.

2. The method of claim 1 wherein said liquid cleaning composition has an adjusted pH of about 7–14.

3. The method of claim 1 wherein said liquid cleaning composition has an adjusted pH of about 11–14.

4. The method of claim 1 wherein said liquid cleaning composition is a concentrate comprising from about 10% to about 100% by weight of said at least one compound selected from the group consisting of salicylic acid, salicylic acid derivatives and mixtures thereof.

5. The method of claim 1 wherein said liquid cleaning composition is in a ready to use form, comprising:

a) about 1% to about 20% by weight of said at least one compound selected from the group consisting of salicylic acid, salicylic acid derivatives and mixtures thereof; and b) said at least one solvent.

6. The method of claim 1 wherein said solvent is selected from the group consisting of water and glycol ether.

7. The method of claim 1 wherein said salicylic acid derivative comprises at least one alkali metal salt of salicylic acid.

8. The method of claim 1 wherein said salicylic acid derivative comprises at least one compound selected from the group consisting of ammonium salicylate, potassium salicylate, sodium salicylate and mixtures thereof.

9. The method of claim 1 wherein said liquid cleaning composition further comprises at least one antimicrobial agent selected from the group consisting of substituted phenolics, quaternary ammonium compounds, peroxygen compounds and mixtures thereof.

10. The method of claim 1 wherein said iodine stain is a povidone iodine stain.

11. The method of claim 1 further comprising a mechanical agitation step.

12. The method of claim 1 wherein said removing step comprises rinsing said substrate to remove any residue left from said liquid cleaning composition on said surface.

13. The method of claim 1 wherein said surface is a hard surface.

14. The method of claim 1 wherein said contacting step is less than 5 hours.

15. The method of claim 4 further comprising the step of diluting said concentrate with an aqueous liquid prior to said contacting step.

16. The method of claim 8 wherein said solvent is water.

17. The method of claim 13 wherein said hard surface is an architectural surface.

18. The method of claim 13 wherein said hard surface is selected from the group consisting of flooring, finished flooring, containers, plastics, walls and finished walls.

19. The method of claim 15 wherein said concentrate is diluted with water at a ratio of about 10:1 to about 1:10 water to concentrate.

20. The method of claim 17 wherein said liquid cleaning composition has an adjusted pH of 12.

21. The method of claim 18 wherein said hard surface is a finished wall including wall paper or paint or both.

22. The method of claim 17 wherein said hard surface is ceramic tile or linoleum finished with a floor finish.

23. A method of removing stains of iodine complexed with polyvinylpyrrolidone comprising the steps of:

a) applying a cleaning composition to a surface having a stain of iodine complexed with polyvinylpyrrolidone, said cleaning composition comprising:

i) at least one compound selected from the group consisting of salicylic acid, salicylic acid derivatives, or mixtures thereof; and ii) at least one solvent with which said at least one compound is soluble or emulsifiable; and b) allowing said cleaning composition to decolorized said stain of iodine complexed with polyvinylpyrrolidone; and c) removing said decolorized stain of iodine complexed with polyvinylpyrrolidone from said surface.

24. A method of removing iodine stains comprising the steps of contacting a surface having an iodine stain with a liquid cleaning composition to decolorize said iodine stain, said liquid composition comprising about 1% to about 100% by weight of at least one compound selected from the group consisting of salicylic acid, salicylic acid derivatives and mixtures thereof and at least one solvent selected from the group consisting of $C_1$ to $C_6$ alkanols, ethers, glycol ethers, water and mixtures thereof, said liquid composition having an adjusted pH of about 1–14 and removing said decolorized iodine stain from said surface.

* * * * *

UNITED STATES PATENT AND TRADEMARK OFFICE

CERTIFICATE OF CORRECTION

PATENT NO. : 6,309,471 B1
DATED : October 30, 2001
INVENTOR(S) : Kim R. Smith et al.

It is certified that error appears in the above-identified patent and that said Letters Patent is hereby corrected as shown below:

Column 3,
Line 30, delete "hereof," -- insert thereof --.

Column 6,
Line 54, delete "lark," -- insert dark --.

Signed and Sealed this

Twenty-eighth Day of May, 2002

*Attest:*

*Attesting Officer*

JAMES E. ROGAN
*Director of the United States Patent and Trademark Office*